US009775488B2

(12) United States Patent
Lundberg et al.

(10) Patent No.: US 9,775,488 B2
(45) Date of Patent: Oct. 3, 2017

(54) TABLE TOP DISHWASHER

(75) Inventors: Mats Lundberg, Vaellingby (SE); Luigi Salerno, Cinisello Balsamo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 839 days.

(21) Appl. No.: 13/996,617

(22) PCT Filed: Dec. 20, 2011

(86) PCT No.: PCT/EP2011/073478

§ 371 (c)(1),
(2), (4) Date: Aug. 4, 2014

(87) PCT Pub. No.: WO2012/085002

PCT Pub. Date: Jun. 28, 2012

(65) Prior Publication Data

US 2015/0020855 A1 Jan. 22, 2015

(30) Foreign Application Priority Data

Dec. 21, 2010 (EP) ..... 10015869

(51) Int. Cl.

*A47L 15/23* (2006.01)
*A47L 15/00* (2006.01)
*A47L 15/42* (2006.01)

(52) U.S. Cl.

CPC ..... *A47L 15/23* (2013.01); *A47L 15/0089* (2013.01); *A47L 15/4246* (2013.01)

(58) Field of Classification Search

CPC ..... A47L 15/23
See application file for complete search history.

(56) References Cited

U.S. PATENT DOCUMENTS

| | | | |
|---|---|---|---|
| 3,934,822 | A | 1/1976 | Ross |
| 5,727,581 | A | 3/1998 | Tekriwal et al. |
| 2008/0271759 | A1 | 11/2008 | Burrows et al. |
| 2009/0320892 | A1 | 12/2009 | Poyner et al. |
| 2010/0024851 | A1 | 2/2010 | Rockwell et al. |

FOREIGN PATENT DOCUMENTS

| | | | |
|---|---|---|---|
| EP | 0990413 | A1 | 4/2000 |
| EP | 1925249 | A1 | 5/2008 |
| EP | 2468170 | A1 | 6/2012 |

OTHER PUBLICATIONS

International Searching Authority, International Search Report for International Application No. PCT/EP2011/073478, mailed Jul. 11, 2012, 4 pages, European Patent Office, The Netherlands.
International Preliminary Report on Patentability and Written Opinion for Application No. PCT/EP2011/073478 dated Jun. 25, 2013.
International Searching Authority, International Search Report for International Application No. PCT/EP2011/073478, dated Jul. 11, 2012, 4 pages, European Patent Office, The Netherlands.

*Primary Examiner* — Jason Ko
(74) *Attorney, Agent, or Firm* — Alston & Bird LLP

(57) ABSTRACT

A dishwasher comprises: (a) a washing chamber for accommodating articles to be cleaned, and comprising in its lower portion a water-collecting sump floor (12); (b) a spray arm (22) rotatably supported at the sump floor; in accordance with the present invention the dishwasher further comprises (c) a sump member (28) which comprises an insert in the sump floor (12) and which comprises an integral spray arm support (24) which rotatably supports the spray arm (22).

20 Claims, 3 Drawing Sheets

TABLE TOP DISHWASHER

CROSS REFERENCE TO RELATED APPLICATIONS

This application is a national stage application, filed under 35 U.S.C. §371, of International Application No. PCT/EP2011/073478, filed Dec. 20, 2011, which claims priority to European Patent Application No. 1001 5869.0, filed Dec. 21, 2010, both of which are hereby incorporated by reference in their entirety.

The present invention relates to a dishwasher comprising a washing chamber for accommodating articles to be cleaned, and comprising in its lower portion a water-collecting sump floor, and a spray arm rotatably supported at the sump floor.

In EP-A-0 990 413 there is shown a dishwasher which comprises a washing chamber for accommodating articles to be cleaned, and which comprises in its lower portion a water-collecting sump. A spray arm is rotatably supported on a support pillar provided at the floor of the sump.

In dishwashers the spray arm usually is driven solely by water reaction forces that are created by the water jets ejected from the spray arm. To this end the spray arm commonly is provided with at least one spray nozzle which ejects a water jet at an angle with respect to the axis of rotation of the spray arm, which results in that a portion of the water circulated within the washing chamber will be necessarily will sprayed towards the side walls of the washing chamber and hence is not available for washing purposes.

In order to divert as little water as possible for driving purposes, attempts have been made to reduce the friction created between the rotatable spray arm and the spray arm support. While spray arms of modern dishwasher commonly are formed of polypropylene (PP) or similar thermoplastic materials, it has been suggested to use such PP spray arms in combination with spray arm supports that are made of a low friction material, such as polyoxymethylene (POM), which sometimes also is referred to as acetal, polyacetal or polyformaldehyde.

Such latter solution is considered to be disadvantageous because when employing such special material spray arm supports additional components are required for mounting such spray arm support means at the sump floor, which thus further complicates the assembly of the dishwasher.

In view of the above, it is an object of the present invention to provide for a dishwasher, which provides for a higher integrity of its components and which thus further facilitates assembly of the dishwasher.

In a dishwasher comprising a washing chamber for accommodating articles to be cleaned and comprising in its lower portion a water-collecting sump floor and a spray arm rotatably supported at the sump floor, the above object is solved in that the dishwasher further comprises a sump member which comprises an insert in the sump floor and which comprises an integral spray arm support which rotatably supports the spray arm.

Instead of providing for a spray arm support which is a separate member that has to be attached at the sump floor, in accordance with the present invention the spray arm support is provided as an integral portion of a sump member which is an insert in the sump floor. In this manner on the one hand no additional mounting steps are required for installing the spray arm support, while on the other hand the spray arm support nevertheless can be made of a material which can be optimally matched to the material of the spray arm. Furthermore, by providing the spray arm support as an integral portion of a sump floor insert, it is possible to provide for a particularly compact design of the spray arm support. Thus, whereas in prior art dishwashers the spray arm support, which usually is a tubular member, had to be supported in a mounting member which is provided at the sump floor and which had to have a certain length so as to stably support the spray arm support, in the integrated solution suggested herein the height of construction of the prior art mounting section for the spray arm support is saved, so that the dishwasher as such can be provided with a reduced overall height. The latter is of particular importance when the dishwasher is designed as a compact dishwasher, such as a table top dishwasher, i.e. a dishwasher which in contrast to common floor-mounted appliances is designed as a smaller unit which may be placed on a kitchen worktop or which is designed as a portable device for use for example in mobile vehicles such as motorhomes, camper vans, yachts and the like.

Preferred embodiments of the present invention are defined in the dependent claims.

In particular, whereas the sump floor usually is made of stainless steel, or as it has been suggested for some modern compact dishwashers can be made of polypropylene (PP), the sump member which comprises an insert in the sump floor preferably is made of a low friction material, in particular a polymer material, preferably a thermoplastic material, for example of polyoxymethylene (POM) or polytetrafluoroethylene (PTFE), so as to provide for low friction between the spray arm support and the spray arm. Furthermore, these materials exhibit a high dimensional stability. Using a thermoplastic material for the sump member further allows the fabrication of complex designs in a single casting or pressing process.

If the sump member is made of a polymer material comprising an admixture of reinforcing additive, such as glass fibers, carbon fibers, or polytetrafluoroethylene (PTFE), also polymer materials can be employed which are available at lower costs but which as such have a lower stability, such as polypropylene (PP).

Also the spray arm can be made of a polymer material, preferably a thermoplastic material, such as polypropylene (PP) which is particularly suitable for forming complex spray arm shapes, wherein reinforcing additives, such as glass fibers, carbon fibers, or polytetrafluoroethylene (PTFE), or friction reducing additives, such as talc can be admixed to the polymer base material.

In preferred embodiments, the sump member comprises a drain aperture for withdrawing water from the sump. Thus, not only the spray arm support but also the drain is integrated into the sump member, which further improves integrity of the dishwasher.

In order to enhance the flow of water that has accumulated at the sump floor into the drain aperture, the sump member preferably comprises a funnel shape section which merges into the drain aperture. Preferably, a tubular filter element is provided in the drain aperture, so as to remove soil particles from the water which has reached the drain aperture, before such water is fed to a circulation pump to again be sprayed onto articles to be cleaned.

In further preferred embodiments, the water collecting sump floor cooperates with the sump member to form a flow chamber via which water from the drain aperture can be passed to a drain conduit. Such an embodiment not only further reduces the number of parts to be assembled during manufacturing of the dishwasher but further allows a particular compact design of the dishwasher in that the flow chamber in which water is collected from the sump, preferably after having been passed through a filter element, and from which such water is passed to a drain conduit is integrally formed by the sump floor and the sump member. Thus, the sump floor for example can form the floor and side walls of the flow chamber, whereas the roof section of the flow chamber is formed by the sump member.

Similarly, the dishwasher can be designed such that the water collecting sump floor cooperates with the sump member to also form at least a portion of the drain conduit. Thus, the provision of a separate drain conduit that has to be connected to the flow chamber is not necessary.

Preferably, the water collecting sump floor cooperates with the sump member to form a generally annular inlet to the flow chamber, so that the entire circumference of the tubular filter element can be used for filtering purposes.

In such embodiments, the flow section of the annular inlet preferably varies about the circumference of the annular inlet, for example by providing for a plurality of spacers between the sump floor and the sump member in proximity to the annular inlet, wherein the height of the spacers differs about the circumference of the annular inlet so that the open area of the annular inlet varies about its circumference. In this manner, it is possible to provide for a substantially homogeneous flow rate through the tubular filter, despite the fact that the overall flow within the flow chamber from which water is passed to the drain aperture necessarily is inhomogeneous. Hence, in embodiments in which a drain pump is connected to the drain conduit, which when operating the drain pump inevitably results in the suction about the annular inlet being inhomogeneous about the circumference of the annular inlet, this at least in part can be compensated by providing the annular inlet with a flow section which varies about the circumference of the annular inlet.

In further preferred embodiments, the dishwasher comprises an integral fitting for connecting the drain conduit to a hydraulic component of the dishwasher, such as a circulation pump, a drain pump or a drain port. While the drain conduit can be formed by cooperation of the water collecting sump floor and the sump member, such integral fitting thus can be provided either at the sump floor, at the sump member or at a combined section of sump floor and sump member.

Preferably, the sump member, at the interface of the sump member and the sump floor, comprises a sealing element, which sealing element in preferred embodiments comprises a sealing lip which is integrally formed at the perimeter of the sump member. While in embodiments wherein the sump floor is designed to extend below the sump member, for example to form flow channels such as the flow chamber via which water from the drain aperture is passed to the drain conduit, an ingress of water at the interface of the sump member and the sump floor may be tolerated, providing for a sealing at such interface can be of particular advantage in embodiments wherein the sump floor and the sump member cooperate to form the flow chamber and optionally also a drain conduit, because in this manner it can be avoided that a circulation pump or a drain pump which during operation of the dishwasher at least temporarily will be connected to such drain conduit and flow chamber sucks in air from within the washing chamber. In this manner cavitation problems in such pumps are effectively avoided.

Preferably, the sump member comprises an integral fitting for connection of a water supply conduit for feeding water to the spray arm, so as to further minimize the number of parts to be assembled during manufacturing of the dishwasher.

Preferred embodiments are described in further detail below by reference to the drawings in which.

Figure 1:
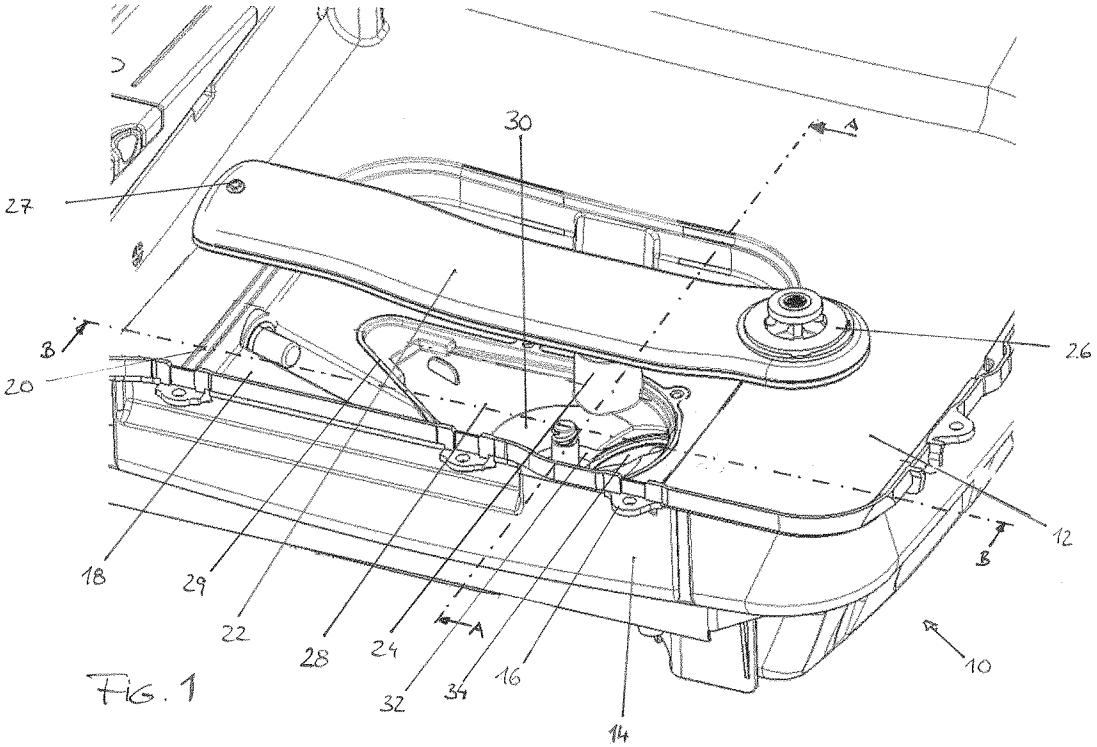
FIG. 1 is a perspective view of the sump of a dishwasher made in accordance with the present invention.

FIG. 1 shows a sump module 10 of a dishwasher in which sump module 10 forms the lower section of a washing compartment. In the embodiment shown in FIG. 1, sump module 10 is made of a thermoplastic material and comprises a generally tub-shaped member the floor of which forms a sump floor 12. Along the upper edge of side walls 14 of sump module 10 there are provided a plurality of mounting lugs 16 with which sump module 10 can be attached to the upper section of the washing chamber. In the central section of sump floor 12 there is a depression 18 which along its upper edge is provided with a ledge 20 where in the assembled state of the dishwasher there is provided a flat filter. A spray arm 22 is rotatably supported at a spray arm support 24 which is located centrally with respect to the sump floor 12. In the embodiment shown in FIG. 1, spray arm 22 is the sun arm of a sun arm/satellite arm arrangement in which a spray arm having a plurality of spraying nozzles is rotatably supported at a bearing 26 which is provided at one of the free ends of sun arm 22, which itself also can be provided with spray nozzles such as spray nozzle 27 shown at the free end of sun arm 22 opposite bearing 26.

Spray arm support 24 is an integral part of a sump member 28 which forms an insert in sump floor 12 and which is located within depression 18. Sump member 28 including spray arm support 24 is made of polyoxymethylene (POM) so as to provide for a particular low friction with spray arm 22, which preferably is made of polypropylene (PP). At the interface of sump member 28 and sump floor 12, there is provided a sealing element 29, which preferably is a sealing lip that is integrally formed at the perimeter of sump member 28, such as by overmoulding. The sealing element thus can comprise a sealing lip 29 which is provided about the perimeter of the sump member 28, or as shown in FIG. 3, comprises a sealing element 31 which is provided on a surface section of the sump floor 12 on which sump member 28 rests and which extends along the perimeter of the sump member 28.

Sump member 28 comprises a funnel shaped section 30 in the center of which there is provided a tubular filter element 32 via which the cleaning liquid collected at the sump passes when flowing into a drain aperture 33, from which the cleaning liquid is passed to a circulation pump to again be supplied to spray arm 22 or from which the cleaning liquid is withdrawn from the dishwasher, such as by a drain pump or a hydrostatically operated drain port. At the upper end of tubular filter element 32 there is provided a handle 34 which facilitates removal of the filter element for cleaning purposes.

Figure 2:
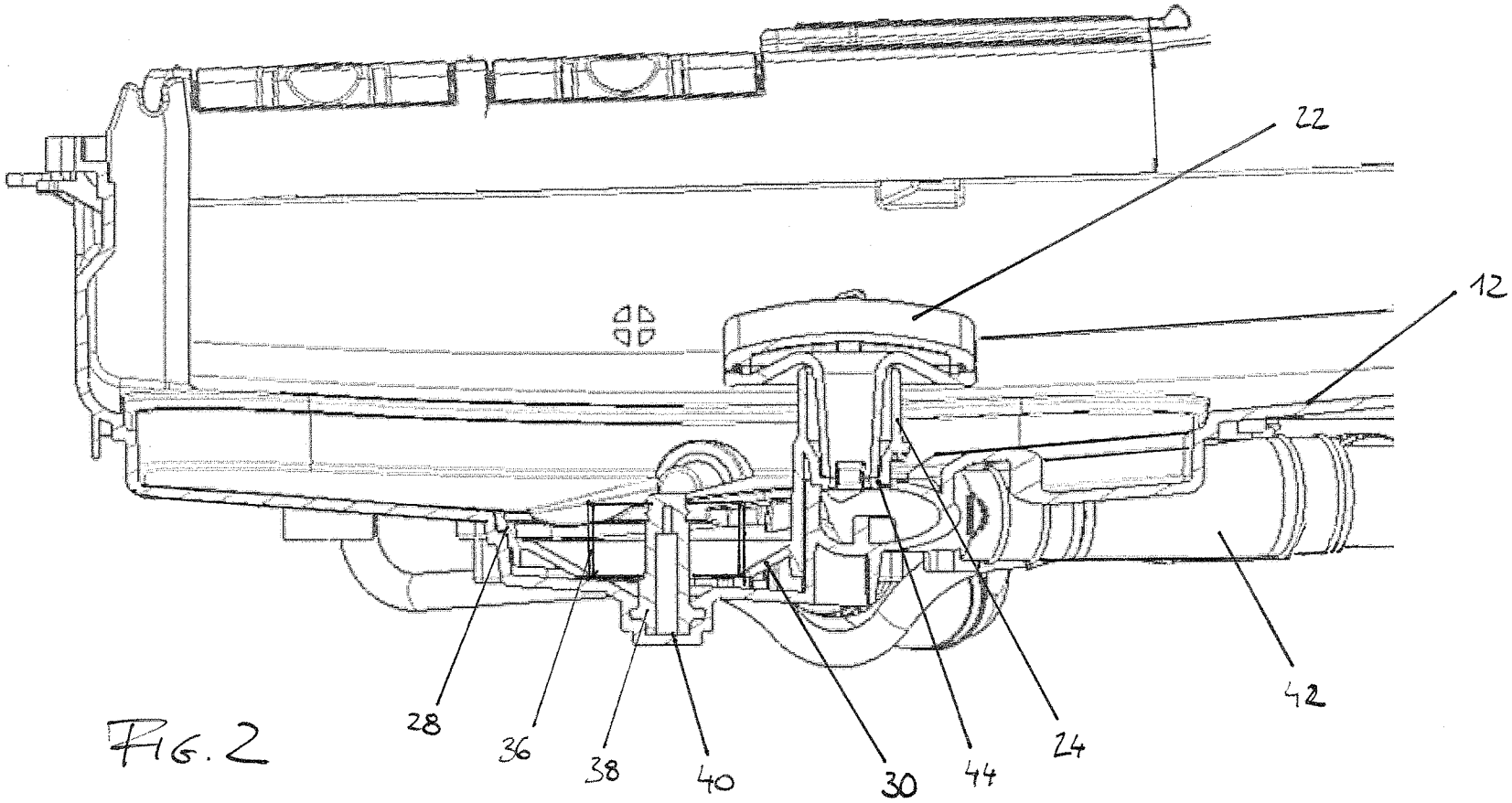
FIG. 2 is a sectional view of the dishwasher of FIG. 1 along line A-A.

FIG. 2 is a sectional view of the sump module 10 of FIG. 1 along line A'a. As is shown in FIG. 2, sump member 28 integrally comprises spray arm support 24 and the funnel shaped section 30 in which there is arranged a tubular filter element 36 which is held with its central support region 38 at a support 40 which constitutes the lower most section of sump member 10 further comprises a water supply line 42 which is connected with a fitting 44 which is integrally formed at the lower section of spray arm support 24.

Figure 3:
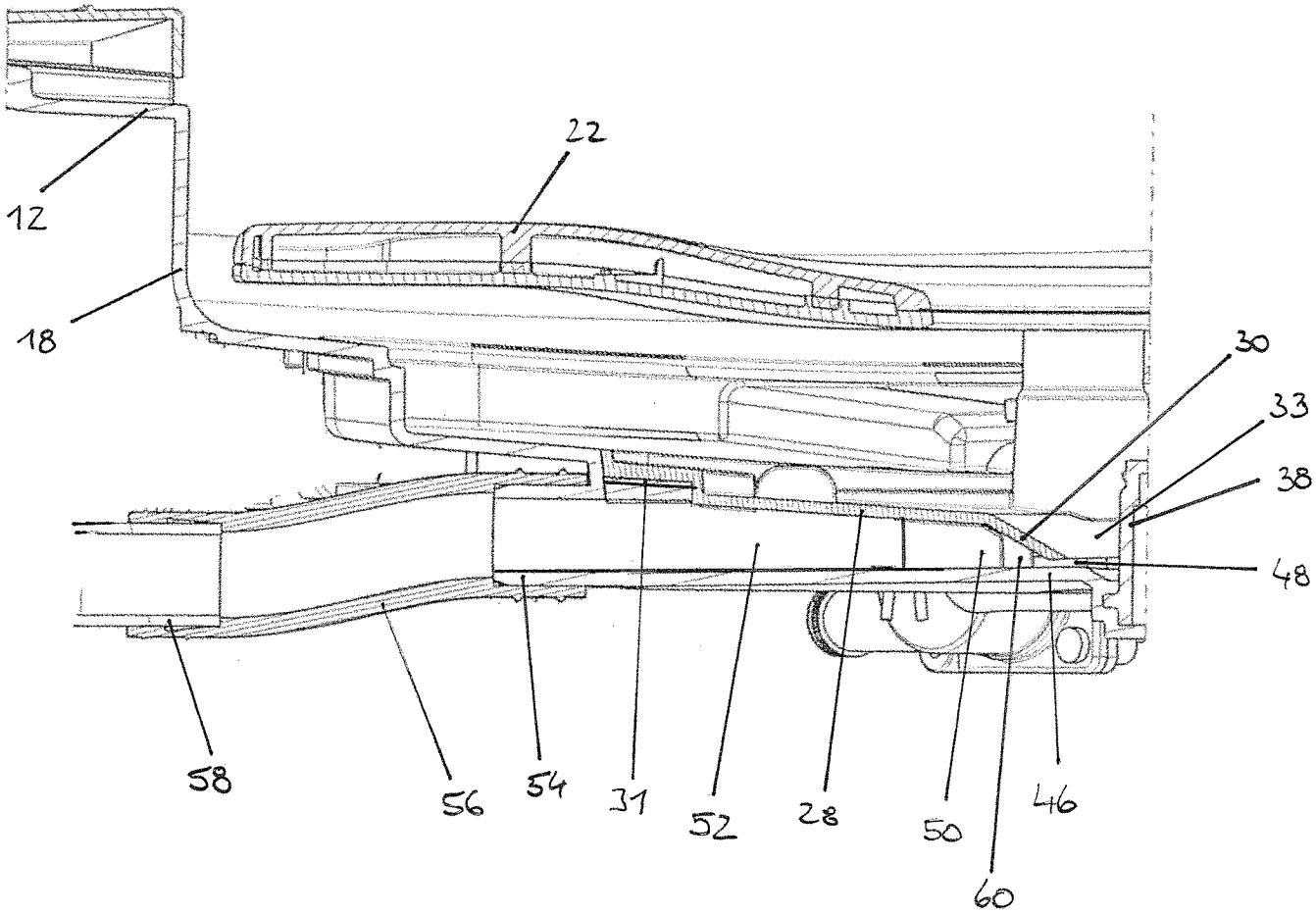
FIG. 3 is a sectional view of the sump of FIG. 1 along a line B-B.

FIG. 3 is a sectional view of sump module 10 along line B-B shown in FIG. 1. As illustrated in FIG. 3, the funnel shaped section 30 of sump member 28 extends towards a floor portion 46 of sump floor 12 and thus forms an annular inlet 48 into a fluid chamber 50 which is formed by cooperation of sump floor 12 and sump member 28. Sump floor 12 and sump member 28 further cooperate to form a drain conduit 52 via which water from flow chamber 50 can be passed to a fitting 54 which is integrally formed at a section of the drain conduit which is formed completely by sump floor 12 from where the water can be passed via a connection tube 56 to the intake 58 of a circulation pump. Since a suction applied to drain conduit 52 will result in a suction at annular inlet 48 that is inhomogeneous about the circumference of the annular inlet, the flow section of annular inlet 48 is varied about its circumference. Thus, at the side facing away from drain conduit 52 annular inlet 48 has a larger flow section than at the side facing towards drain conduit 52. In order to maintain the lower end of funnel shaped section 30 at a desired distance from floor section 46 there are provided a plurality of spacers 60 about the circumference of the annular inlet, which spacers 60 vary in height.

LIST OF REFERENCE SIGNS

10 sump module
12 sump floor
14 side wall
16 mounting lug
18 depression
20 ledge
22 spray arm
24 spray arm support
26 bearing
27 spray nozzle
28 sump member
29 sealing lip
30 funnel shaped section
31 sealing element
32 filter element
33 drain aperture
34 handle
36 filter element
38 support region
40 support
42 supply line
44 supply line fitting
46 floor portion
48 annular inlet
50 flow chamber
52 drain conduit
54 drain line fitting
56 connecting tube
58 intake
60 spacer

The invention claimed is:

1. A dishwasher comprising:

(a) a washing chamber for accommodating articles to be cleaned, and comprising in its lower portion a water-collecting sump floor;

(b) a spray arm rotatably supported at the sump floor; and (c) a sump member inserted into the sump floor and sealed to the sump floor about a perimeter of the sump member, wherein the sump member comprises a spray arm support which rotatably supports the spray arm, and wherein the spray arm support is an integral portion of the sump member, such that the sump member, including the spray arm support, forms a single, contiguous piece of material.

2. The dishwasher of claim 1, wherein the sump member is made of a low friction material.

3. The dishwasher of claim 2, wherein the sump member is made of a polymer material.

4. The dishwasher of claim 3, wherein the sump member is made of polyoxymethylene (POM), polytetrafluoroethylene (PTFE), polypropylene (PP), or mixtures thereof.

5. The dishwasher of claim 3, wherein the sump member is made of a polymer material comprising an admixture of reinforcing additive.

6. The dishwasher of claim 5, wherein the reinforcing additive comprises glass fibers, carbon fibers, or a polymer material that is different from the base material of the sump member.

7. The dishwasher of claim 1, wherein the spray arm is made of a polymer material.

8. The dishwasher of claim 7, wherein the spray arm is made of polypropylene (PP) comprising a reinforcing additive, such as glass fibers, carbon fibers, or polytetrafluoroethylene (PTFE), or a friction reducing additive, such as talc.

9. The dishwasher of claim 1, wherein the sump member comprises a drain aperture for withdrawing water from the sump.

10. The dishwasher of claim 9, wherein the sump member comprises a funnel shaped section which merges into the drain aperture.

11. The dishwasher of claim 9, wherein the water-collecting sump floor cooperates with the sump member to form a flow chamber via which water from the drain aperture can be passed to a drain conduit, and wherein the flow chamber is bonded and defined by both the sump member and sump floor.

12. The dishwasher of claim 11, wherein the water-collecting sump floor cooperates with the sump member to form at least a portion of the drain conduit, and wherein the at least a portion of the drain conduit is bounded and defined by both the sump member and sump floor.

13. The dishwasher of claim 11, wherein the water-collecting sump floor cooperates with the sump member to form a generally annular inlet to said flow chamber, wherein the generally annular inlet is bounded and defined between a circumferential edge of the drain aperture of the sump member and the sump floor.

14. The dishwasher of claim 13, wherein a flow section of the annular inlet varies about the circumference of the annular inlet, such that the flow rate through the annular inlet varies as a function of angular position along the circumference of the annular inlet.

15. The dishwasher of claim 14, comprising a plurality of spacers which are provided between the sump floor and the sump member in proximity to the annular inlet, wherein the height of the spacers differs about the circumference of the annular inlet, such that the height of the respective spacers varies as a function of angular position along the circumference of the annular inlet, and wherein the spacers are configured to maintain the flow section of the annular inlet.

16. The dishwasher of claim 11, further comprising an integral drain line fitting for connecting the drain conduit to a hydraulic component of the dishwasher, such as a circulation pump, a drain pump or a drain port.

17. The dishwasher of claim 1, wherein the sump member, at the interface of the sump member and the sump floor, comprises a sealing element.

18. The dishwasher of claim 17, wherein the sealing element comprises a sealing lip which is integrally formed at the perimeter of the sump member.

19. The dishwasher of claim 1, wherein the sump member comprises an integral supply line fitting for connection of a water supply conduit for feeding pressurized water to the spray arm.

20. The dishwasher of claim 1, wherein the spray arm support comprises a hollow cylinder integrally connected to a remainder of the sump member at one end of the cylinder.

* * * * *